US007015880B2

(12) United States Patent
Lee et al.

(10) Patent No.: US 7,015,880 B2
(45) Date of Patent: Mar. 21, 2006

(54) ADDRESS-WHILE-DISPLAY DRIVING METHOD FOR BROADENING MARGIN OF ADDRESS VOLTAGE OF PLASMA DISPLAY PANEL

(75) Inventors: Joo-yul Lee, Asan (KR); Kyoung-ho Kang, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 311 days.

(21) Appl. No.: 10/295,941

(22) Filed: Nov. 18, 2002

(65) Prior Publication Data

US 2003/0098823 A1 May 29, 2003

(30) Foreign Application Priority Data

Nov. 28, 2001 (KR) ..... 2001-74567

(51) Int. Cl.
*G09G 3/28* (2006.01)

(52) U.S. Cl. ..... 345/60; 315/169.1; 315/169.2; 315/169.3; 315/169.4; 345/37; 345/41; 345/63; 345/67; 349/32

(58) Field of Classification Search ..... 345/60, 345/63, 67, 37, 41; 315/169.1, 169.2, 169.3, 315/169.4; 349/32
See application file for complete search history.

(56) References Cited

U.S. PATENT DOCUMENTS 6,097,358 A * 8/2000 Hirakawa et al. ..... 345/63
6,249,087 B1 * 6/2001 Takayama et al. ..... 315/169.1
6,456,263 B1 * 9/2002 Hashimoto et al. ..... 345/60

FOREIGN PATENT DOCUMENTS

JP 11065516 A * 3/1999
KR 2000-0034676 6/2000

* cited by examiner

*Primary Examiner*—Sumati Lefkowitz
*Assistant Examiner*—Alexander S. Beck
(74) *Attorney, Agent, or Firm*—H.C. Park & Associates, PLC

(57) ABSTRACT

There is provided an address-while-display driving method for a surface discharge type triode plasma display panel, which includes sequentially performing resetting and addressing on each XY-electrode line pair while alternately and consecutively applying display voltages to all XY-electrode line pairs of the panel. The panel includes a front substrate and a rear substrate that are separately formed to face each other, X- and Y-electrode lines that are alternately arranged in parallel between the front and rear substrates to form the XY-electrode line pairs, and address electrode lines that are formed in perpendicular to the X- and Y-electrode lines. The address-while-display driving method includes lowering the display voltages during an addressing time for each XY-electrode line pair.

12 Claims, 10 Drawing Sheets

1
SPX
SPY
ERX
ERY
RE
RA
LL
LU
Vsh
Vpb
Vsl
Veh
Vsc
Vel
Vre
ST1
ST2
ST3
ST4
ST5
ST6
ST7
ST8
ST9
ST10
ST10a
ST11
ST12
ST13
LX
LY
CSX
CSY
XU1
XL1
XU2
XL2
XUn
XLn
YU1
YL1
YU2
YL2
YUn
YLn

ADDRESS-WHILE-DISPLAY DRIVING METHOD FOR BROADENING MARGIN OF ADDRESS VOLTAGE OF PLASMA DISPLAY PANEL

BACKGROUND OF THE INVENTION

1. Field of the Invention

The present invention relates to an address-while-display driving method for a plasma display panel, and more particularly, to an address-while-display driving method for a surface discharge type triode plasma display panel.

2. Description of the Related Art

FIG. 1 shows the structure of a conventional surface discharge type triode plasma display panel (PDP) 1. FIG. 2 shows an example of a display cell of the PDP 1 shown in FIG. 1. Referring to FIGS. 1 and 2, address electrode lines $A_1, A_2, \ldots, A_{m-1}, A_m$; front and rear dielectric layers 11 and 15; Y-electrode lines $Y_1, \ldots, Y_n$; X-electrode lines $X_1, \ldots, X_n$; phosphor layers 16; partition walls 17; and a magnesium oxide (MgO) layer 12 as a protective layer are provided between front and rear glass substrates 10 and 13 of a general surface discharge PDP 1.

The address electrode lines $A_1$ through $A_m$ are formed on the front surface of the rear glass substrate 13 in a predetermined pattern. A rear dielectric layer 15 is formed on the entire surface of the rear glass substrate 13 having the address electrode lines $A_1$ through $A_m$. The partition walls 17 are formed on the front surface of the rear dielectric layer 15 to be parallel to the address electrode lines $A_1$ through $A_m$. These partition walls 17 define the discharge areas of respective display cells and serve to prevent cross talk between display cells. The phosphor layers 16 are deposited between partition walls 17.

The X-electrode lines $X_1$ through $X_n$ and the Y-electrode lines $Y_1$ through $Y_n$ are formed on the rear surface of the front glass substrate 10 in a predetermined pattern to be orthogonal to the address electrode lines $A_1$ through $A_m$. The respective intersections define display cells. Each of the X-electrode lines $X_1$ through $X_n$ is composed of a transparent electrode line $X_{na}$ (FIG. 2) formed of a transparent conductive material, e.g., indium tin oxide (ITO), and a metal electrode line $X_{nb}$ (FIG. 2) for increasing conductivity. Each of the Y-electrode lines $Y_1$ through $Y_n$ is composed of a transparent electrode line $Y_{na}$ (FIG. 2) formed of a transparent conductive material, e.g., ITO, and a metal electrode line $Y_{nb}$ (FIG. 2) for increasing conductivity. A front dielectric layer 11 is deposited on the entire rear surface of the front glass substrate 10 having the rear surfaces of the X-electrode lines $X_1$ through $X_n$ and the Y-electrode lines $Y_1$ through $Y_n$. The protective layer 12, e.g., a MgO layer, for protecting the PDP 1 against a strong electrical field is deposited on the entire surface of the front dielectric layer 1. A gas for forming plasma is hermetically sealed in a discharge space 14.

FIG. 3 shows a typical address-display separation driving method with respect to Y-electrode lines of the PDP 1 shown in FIG. 1. Referring to FIG. 3, to realize time-division gray scale display, a unit frame is divided into 8 subfields SF1 through SF8. In addition, the individual subfields SF1 through SF8 are composed of address periods A1 through A8, respectively, and display periods S1 through S8, respectively.

During each of the address periods A1 through A8, display data signals are applied to the address electrode lines $A_1$ through $A_m$ of FIG. 1, and simultaneously, a scan pulse is sequentially applied to the Y-electrode lines $Y_1$ through $Y_n$. If a high-level display data signal is applied to some of the address electrode lines $A_1$ through $A_m$ while the scan pulse is applied, wall charges are induced from address discharge only in relevant display cells.

During each of the display periods S1 through S8, a display discharge pulse is alternately applied to the Y-electrode lines $Y_1$ through $Y_n$, and the X-electrode lines $X_1$ through $X_n$, thereby provoking display discharge in display cells in which wall charges are induced during each of the address periods A1 through A8. Accordingly, the brightness of a PDP is proportional to a total length of the display periods S1 through S8 in a unit frame. The total length of the display periods S1 through S8 in a unit frame is 255T (T is a unit time). Accordingly, including the case where the display is not performed in a unit frame, 256 gray scales can be displayed. This is explained below.

Here, the display period S1 of the first subfield SF1 is set to a time 1T corresponding to $2^0$. The display period S2 of the second subfield SF2 is set to a time 2T corresponding to $2^1$. The display period S3 of the third subfield SF3 is set to a time 4T corresponding to $2^2$. The display period S4 of the fourth subfield SF4 is set to a time 8T corresponding to $2^3$. The display period S5 of the fifth subfield SF5 is set to a time 16T corresponding to $2^4$. The display period S6 of the sixth subfield SF6 is set to a time 32T corresponding to $2^5$. The display period S7 of the seventh subfield SF7 is set to a time 64T corresponding to $2^6$. The display period S8 of the eighth subfield SF8 is set to a time 128T corresponding to $2^7$.

Accordingly, if a subfield to be displayed is appropriately selected from among 8 subfields, a total of 256 gray scales can be displayed including a gray level of zero at which display is not performed in any subfield.

According to the above-described address-display separation display method, the time domains of the respective subfields SF1 through SF8 are separated, so the time domains of respective address periods of the subfields SF1 through SF8 are separated, and the time domains of respective display periods of the subfields SF1 through SF8 are separated. Accordingly, during a given address period, an XY-electrode line pair is kept waiting after being addressed until all of the other XY-electrode line pairs are addressed. Consequently, in each subfield, an address period increases, and a display period decreases. As a result, the brightness of light emitted from a PDP decreases. An existing method proposed for overcoming this problem is an address-while-display driving method as shown in FIG. 4.

FIG. 4 shows a typical address-while-display driving method with respect to the Y-electrode lines of the PDP 1 shown in FIG. 1. Referring to FIG. 4, to realize time-division gray scale display, a unit frame is divided into 8 subfields $SF_1$ through $SF_8$. Here, the subfields $SF_1$ through $SF_8$ overlap with respect to the Y-electrode lines $Y_1$ through $Y_n$ and constitute a unit frame. Since all of the subfields $SF_1$ through $SF_8$ exist at any time point, address time slots are set among display discharge pulses in order to perform each address step.

In each of the subfields $SF_1$ through $SF_8$, a reset step, address step, and display discharge step are performed. A time allocated to each of the subfields $SF_1$ through $SF_8$ depends on a display discharge time corresponding to a gray scale. For example, in the case of displaying 256 gray scales with 8-bit image data in units of frames, if a unit frame (usually, 1/60 second) is composed of 256 unit times, the first subfield $SF_1$ driven according to image data of the least significant bit has 1 ($2^0$) unit time, the second subfield $SF_2$ has 2 ($2^1$) unit times, the third subfield $SF_3$ has 4 ($2^2$) unit times, the fourth subfield $SF_4$ has 8 ($2^3$) unit times, the fifth subfield $SF_5$ has 16 ($2^4$) unit times, the sixth subfield $SF_6$ has 32 ($2^5$) unit times, the seventh subfield $SF_7$ has 64 ($2^6$) unit times, and the eighth subfield $SF_8$ driven according to image data of the most significant bit has 128 ($2^7$) unit times. Since the sum of unit times allocated to the subfields $SF_1$ through $SF_8$ is 255, 255 gray scale display can be accomplished. If a gray scale at which there is no display discharge in any subfield is included, 256 gray scale display can be accomplished.

FIG. 5 shows a typical driving apparatus for the PDP 1 shown in FIG. 1. Referring to FIG. 5, the typical driving apparatus for the PDP 1 includes an image processor 66, a logic controller 62, an address driver 63, an X-driver 64, and a Y-driver 65. The image processor 66 converts an external analog image signal into a digital signal to generate an internal image signal composed of, for example, 8-bit red (R) image data, 8-bit green (G) image data, 8-bit blue (B) image data, a clock signal, a horizontal synchronizing signal, and a vertical synchronizing signal. The logic controller 62 generates drive control signals $S_A$, $S_Y$, and $S_X$ in response to the internal image signal from the image processor 66. The address driver 63 processes the address signal $S_A$ among the drive control signals $S_A$, $S_Y$, and $S_X$ output from the logic controller 62 to generate a display data signal and applies the display data signal to address electrode lines. The X-driver 64 processes the X-drive control signal $S_X$ among the drive control signals $S_A$, $S_Y$, and $S_X$ output from the logic controller 62 and applies the result of processing to X-electrode lines. The Y-driver 65 processes the Y-drive control signal $S_Y$ among the drive control signals $S_A$, $S_Y$, and $S_X$ output from the logic controller 62 and applies the result of processing to Y-electrode lines.

FIG. 6 shows driving signals applied to electrode lines according to a conventional address-while-display driving method. In FIG. 6, a reference character $S_{X1}$ denotes a driving signal applied to an X-electrode line of an XY-electrode line pair performing initial resetting and addressing in a unit frame FR1, and a reference character $S_{Y1}$ denotes a driving signal applied to the Y-electrode line of the XY-electrode line pair performing the initial resetting and addressing in the unit frame FR1. A reference character $S_{X2}$ denotes a driving signal applied to an X-electrode line of an XY-electrode line pair performing second resetting and addressing in the unit frame FR1, and a reference character $S_{Y2}$ denotes a driving signal applied to the Y-electrode line of the XY-electrode line pair performing the second resetting and addressing in the unit frame FR1. A reference character $S_{Xn}$ denotes a driving signal applied to an X-electrode line of an XY-electrode line pair performing last resetting and addressing in the unit frame FR1, and a reference character $S_{Yn}$ denotes a driving signal applied to the Y-electrode line of the XY-electrode line pair performing the last resetting and addressing in the unit frame FR1. A reference character $S_{A1 \ldots m}$ denotes a display data signal applied from the address driver 63 of FIG. 5 to all address electrode lines.

The conventional address-while-display driving method will be described in detail with reference to FIG. 6.

As shown in FIG. 6, in an address-while-display driving method for a PDP, resetting and addressing are performed on the XY-electrode line pairs $X_1Y_1$, $X_2Y_2$, . . . , $X_nY_n$ while a positive voltage Vsh of a third level and a negative voltage Vs1 of a first level are alternately applied to all of the X- and Y-electrode lines $X_1$ through $X_n$ and $Y_1$ through $Y_n$ shown in FIG. 1

A resetting process includes a line discharge step ta–t1, an erasure step tb–tc, and iteration steps. Since a second subfield corresponding to a first XY-electrode line pair starts after a first subfield corresponding to the first XY-electrode line pair performing initial resetting and addressing in a unit frame FR1, during a first pulse width period t0–t1, the negative voltage Vs1 of the first level is applied to all of the X-electrode lines $X_1$ through $X_n$, and simultaneously, the positive voltage Vsh of the third level is applied to all of the Y-electrode lines $Y_1$ through $Y_n$. In the line discharge step ta–t1, during the first pulse width period t0–t1, a negative voltage Vsc of a second level higher than the first level is applied to the X-electrode line $X_1$ of the first XY-electrode line pair $X_1Y_1$, and simultaneously, a positive voltage Vre of a sixth level higher than the third level is applied to the Y-electrode line $Y_1$ of the first XY-electrode line pair $X_1Y_1$. Accordingly, discharges are provoked in all display cells corresponding to the first XY-electrode line pair $X_1Y_1$, thereby uniformly forming wall charges and satisfactorily forming space charges.

During a second pulse width period t1–t2, immediately after the first pulse width period t0–t1 during which the line discharge step ta–t1 is performed, the positive voltage Vsh of the third level is applied to all of the X-electrode lines $X_1$ through $X_n$, and simultaneously, the negative voltage Vs1 of the first level is applied to all of the Y-electrode lines $Y_1$ through $Y_n$, so that wall charges are uniformly formed and space charges are satisfactorily formed in all of the display cells corresponding to the first XY-electrode line pair $X_1Y_1$.

In an erasure step performed for a predetermined time tb–tc, during a third pulse width period t2–t3 immediately after the second pulse width period t1–t2, a positive voltage Veh of a seventh level lower than the third level is applied to the X-electrode line $X_1$ of the first XY-electrode line pair $X_1Y_1$, and simultaneously, a negative voltage Vel of an eighth level lower than the first level is applied to the Y-electrode line $Y_1$ of the first XY-electrode line pair $X_1Y_1$. Accordingly, wall charges are erased from all of the display cells corresponding to the first XY-electrode line pair $X_1Y_1$. However, the space charges satisfactorily remain in the display cells.

The steps of forming and erasing wall charges are sequentially performed on each of the remaining XY-electrode line pairs (see driving signals $S_{X2}$ and $S_{Y2}$ of FIG. 6).

In FIG. 6, durations td–te, th–ti, and ty–tz are addressing times, during which wall charges are formed in selected display cells, after resetting. These addressing times td–te, th–ti, and ty–tz correspond to times t3–t4, t5–t6, and t2*n*+1–t2*n*+2, respectively, during which the negative voltage Vs1 of the first level is applied to all of the Y electrode lines $Y_1$ through $Y_n$. During these addressing times td–te, th–ti, and ty–tz, the negative scan voltage Vsc of the second level higher than the first level is applied to the respective Y-electrode lines of XY-electrode line pairs $X_1Y_1$, $X_2Y_2$, and $X_nY_n$ to be addressed, and simultaneously, positive display data signals are applied to all of the address electrode lines $A_1$ through $A_m$ shown in FIG. 1. Accordingly, opposite discharges occur among the Y-electrode line of an XY-electrode line pair to be addressed and selected address electrode lines, thereby forming positive wall charges around the Y-electrode of selected display cells. In the selected display cells, display discharges are performed in response to pulses due to a wall voltage induced from the wall charges.

According to the conventional address-while-display driving method, display voltages that are alternately applied to the X- and Y-electrode lines of each of all XY-electrode line pairs are constant. Accordingly, a voltage that is applied to each XY-electrode line pair is relatively higher during the addressing times td–te, th–ti, and ty–tz than during other times, and thus a maximum of the address voltage Va applied to selected lines among all address electrode lines $A_1$ through $A_m$ decreases. In other words, an applicable range, i.e., margin, of the address voltage Va is narrowed. When the margin of the address voltage Va is narrowed, display performance may be degraded due to incorrect and inaccurate addressing.

SUMMARY OF THE INVENTION

To solve the above-described problems, it is an object of the present invention to provide an address-while-display driving method for increasing the margin of an address voltage in a surface discharge type triode PDP in order to increase the accuracy of addressing, thereby increasing display performance.

To achieve the above object of the present invention, there is provided an address-while-display driving method of sequentially performing resetting and addressing on each XY-electrode line pair while alternately and consecutively applying display voltages to all XY-electrode line pairs in a surface discharge type triode PDP, which includes a front substrate and a rear substrate that are separately formed to face each other, X- and Y-electrode lines that are alternately arranged in parallel between the front and rear substrates to form the XY-electrode line pairs, and address electrode lines that are formed perpendicular to the X- and Y-electrode lines. The address-while-display driving method of an embodiment of the present invention includes lowering the display voltages during an addressing time for each XY-electrode line pair.

According to the address-while-display driving method of an embodiment of the present invention, since a voltage applied to each XY-electrode line pair is lowered during a corresponding addressing time, a maximum of an address voltage that is applied to selected lines among all address electrode lines increases. As a result, the margin of the address voltage increases, and thus accuracy of addressing increases. Consequently, display performance is increased.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 6:
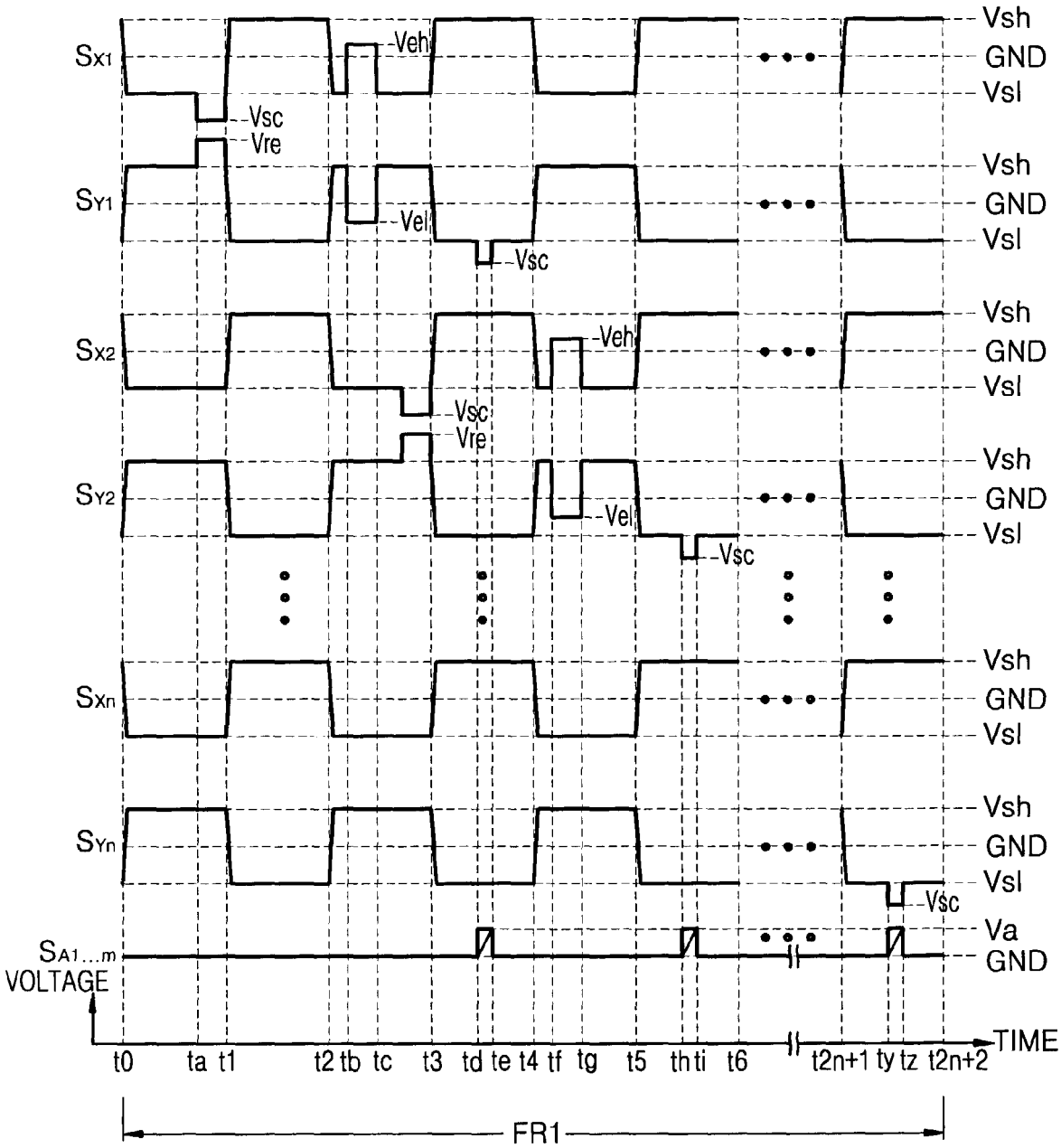
FIG. 6 (PRIOR ART)
FIG. 6 is a timing chart showing driving signals that are applied to electrode lines according to a conventional address-while-display driving method.
Figure 7:
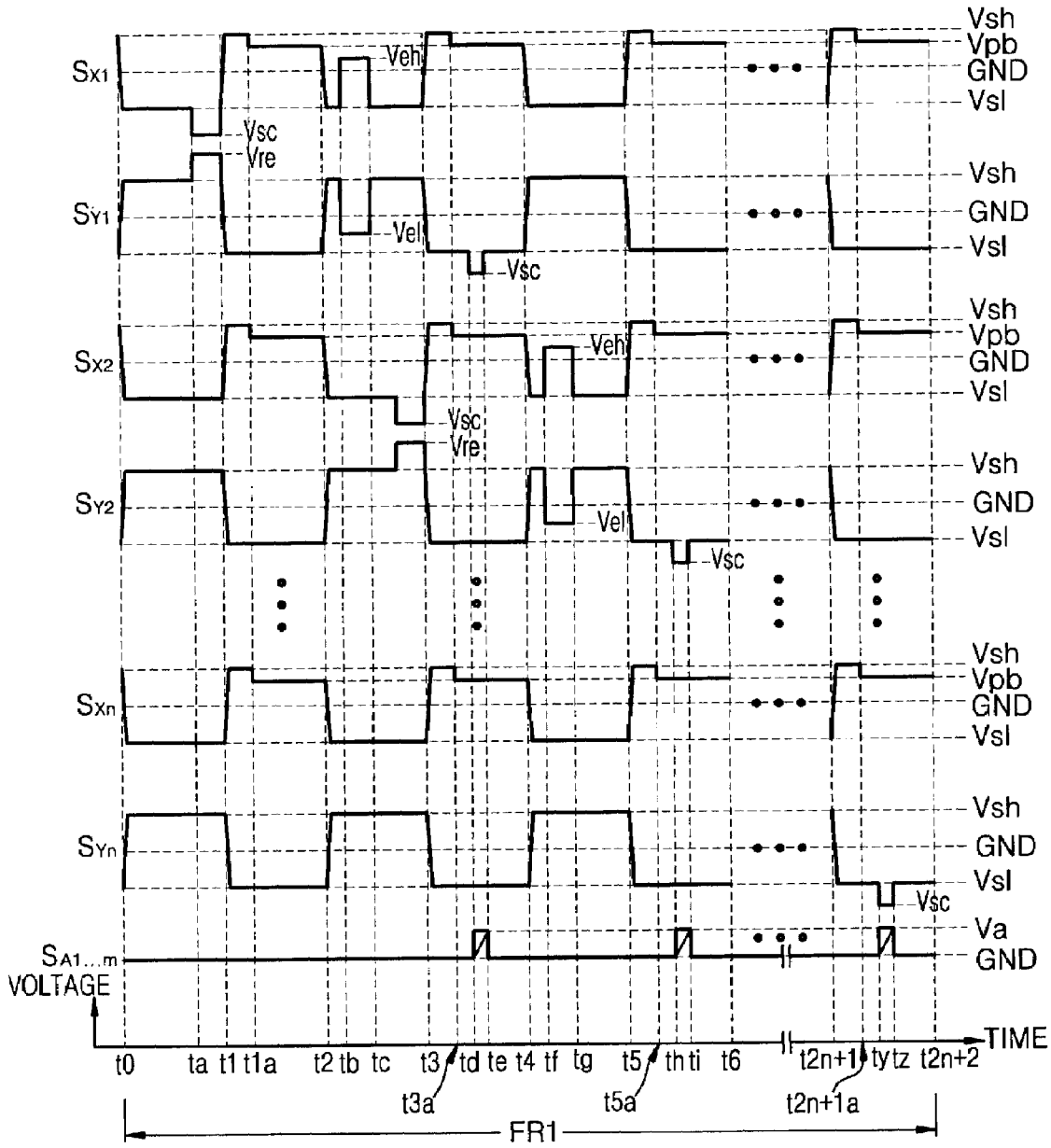
FIG. 7 is a timing chart showing driving signals that are applied to electrode lines according to an address-while-display driving method according to a first embodiment of the present invention.
Figure 8:
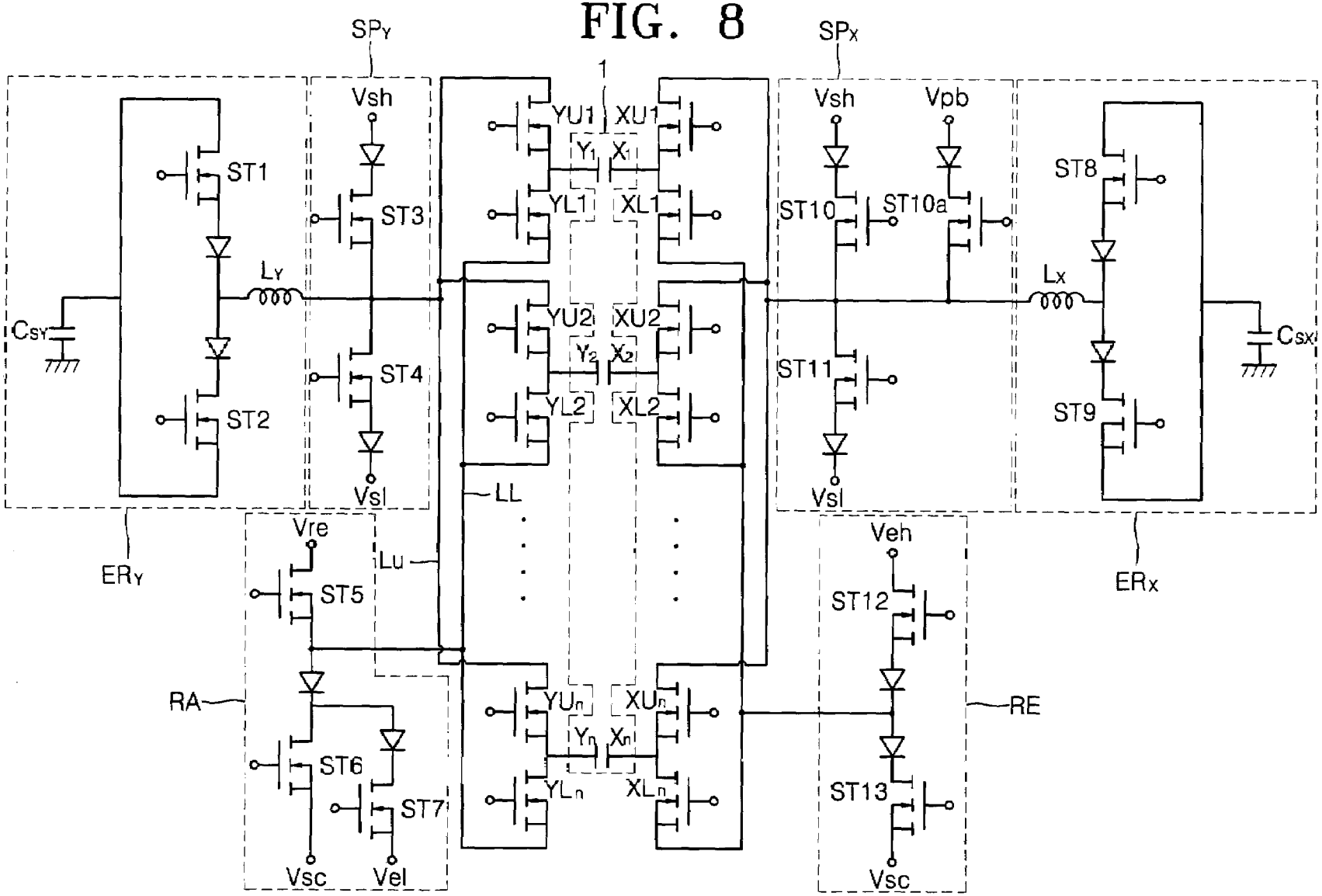
FIG. 8 is a circuit diagram of X- and Y-drivers that can perform the address-while-display driving method of FIG. 7.

FIG. 7 shows driving signals that are applied to electrode lines according to an address-while-display driving method according to a first embodiment of the present invention. In FIGS. 6 and 7, the same reference characters denote the same functional element. FIG. 8 shows X- and Y-drivers that can perform the address-while-display driving method of FIG. 7. In FIG. 8, a circuit at the left side of a PDP 1 corresponds to the Y-driver 65 shown FIG. 5, and a circuit at the right side of the PDP 1 corresponds to the X-driver 64 shown FIG. 5.

Figure 5:
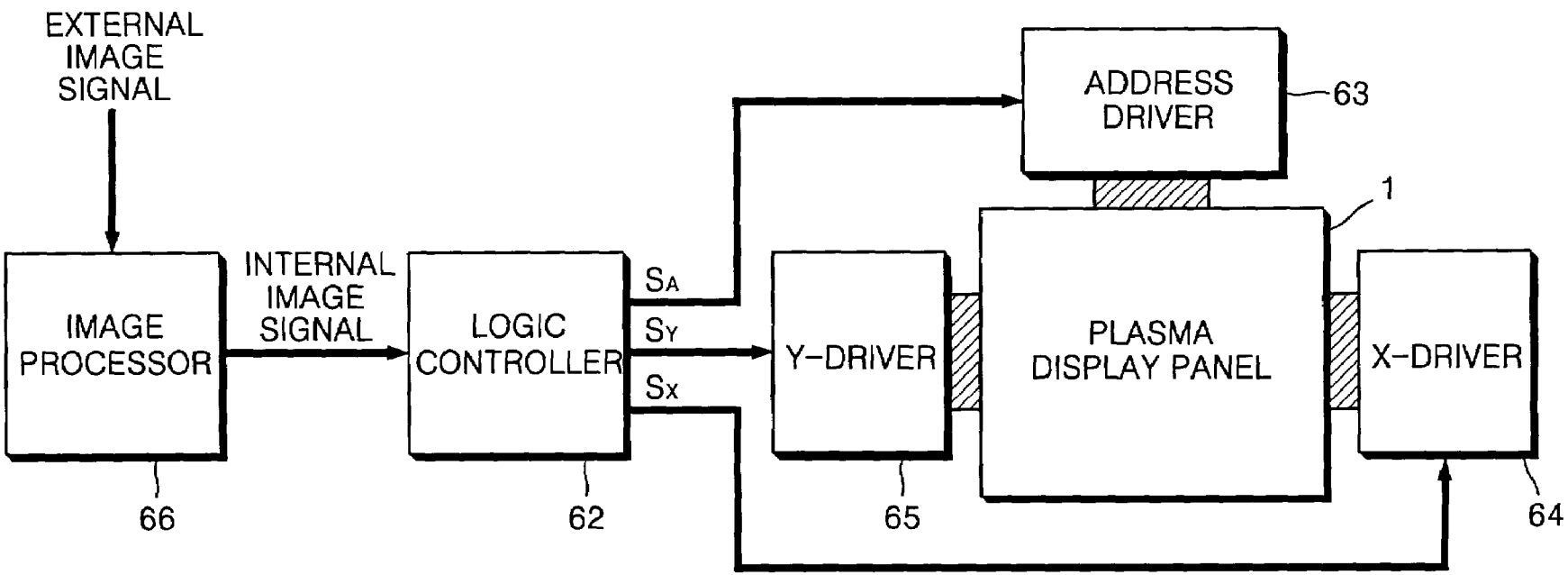
FIG. 5 (PRIOR ART)
FIG. 5 is a block diagram of a typical driving apparatus for the PDP shown in FIG. 1.

Referring to FIG. 8, the Y-driver 65 of FIG. 5 includes upper transistors YU1 through $YU_n$, lower transistors YL1 through $YL_n$, a Y-energy regeneration circuit $ER_Y$, a Y-display discharge circuit $SP_Y$, and a Y-resetting/addressing circuit RA. The upper transistors YU1 through $YU_n$ and the lower transistors YL1 through $YL_n$ are connected to Y-electrode lines $Y_1$ through $Y_n$. The Y-energy regeneration circuit $ER_Y$ collects charges around the Y-electrode lines $Y_1$ through $Y_n$ during the falling time of display discharge pulses simultaneously applied from the Y-display discharge circuit $SP_Y$ to the Y-electrode lines $Y_1$ through $Y_n$ and applies the collected charges to the Y-electrode lines $Y_1$ through $Y_n$ during the rising time of the display discharge pulses. The Y-display discharge circuit $SP_Y$ alternately applies a positive voltage Vsh of a third level and a negative voltage Vs1 of a first level to the Y-electrode lines $Y_1$ through $Y_n$. The Y-energy regeneration circuit $ER_Y$ and the Y-display discharge circuit $SP_Y$ are commonly applied to all of the Y-electrode lines $Y_1$ through $Y_n$ through the upper transistors YU1 through $YU_n$. The Y-resetting/addressing circuit RA outputs voltages Vre and Vel for resetting according to the present invention and a voltage Vsc for addressing during resetting time and addressing time for each Y-electrode line. Accordingly, the Y-resetting/addressing circuit RA is independently applied to each of the Y-electrode lines $Y_1$ through $Y_n$ through each of the lower transistors YL1 through $YL_n$.

Similarly, the X-driver 64 of FIG. 5 includes upper transistors XU1 through $XU_n$, lower transistors XL1 through $XL_n$, an X-energy regeneration circuit $ER_X$, an X-display discharge circuit $SP_X$, and an X-resetting circuit RE. The upper transistors XU1 through $XU_n$ and the lower transistors XL1 through $XL_n$ are connected to X-electrode lines $X_1$ through $X_n$. The X-energy regeneration circuit $ER_X$ collects charges around the X-electrode lines $X_1$ through $X_n$ during the falling time of display discharge pulses simultaneously applied from the X-display discharge circuit $SP_X$ to the X-elcctrode lines $X_1$ through $X_n$ and applies the collected charges to the X-electrode lines $X_1$ through $X_n$ during the rising time of the display discharge pulses. The X-display discharge circuit $SP_X$ alternately applies the positive voltage Vsh of the third level plus a positive voltage Vpb of a fourth level and the negative voltage Vs1 of the first level to the X-electrode lines $X_1$ through $X_n$. The X-energy regeneration circuit $ER_X$ and the X-display discharge circuit $SP_X$ are commonly applied to all of the X-electrode lines $X_1$ through $X_n$ through the upper transistors XU1 through $XU_n$. The X-resetting circuit RE outputs voltages Veh and Vsc for resetting according to the present invention during resetting time for each X-electrode line. Accordingly, the X-resetting circuit RE is independently applied to each of the X-electrode lines $X_1$ through $X_n$ through each of the lower transistors XL1 through $XL_n$.

An address-while-display driving method according to an embodiment of the present invention will be described in detail with reference to FIGS. 7 and 8.

As shown in FIG. 7, in an address-while-display driving method for a PDP 1, resetting and addressing are performed on the XY-electrode line pairs $X_1Y_1, X_2Y_2, \ldots, X_nY_n$ while the positive voltage Vsh of the third level plus the positive voltage Vpb of the fourth level and the negative voltage Vs1 of the first level are alternately applied to all of the X- and Y-electrode lines $X_1$ through $X_n$ and $Y_1$ through $Y_n$.

A resetting process includes a line discharge step ta–t1, an erasure step tb–tc, and iteration steps. Since a second subfield corresponding to a first XY-electrode line pair starts after a first subfield corresponding to the first XY-electrode line pair performing initial resetting and addressing in a unit frame FR1, during a first pulse width period t0–t1, the negative voltage Vs1 of the first level is applied to all of the X-electrode lines $X_1$ through $X_n$, and simultaneously, the positive voltage Vpb of the third level is applied to all of the Y-electrode lines $Y_1$ through $Y_n$. In the line discharge step ta–t1, during the first pulse width period t0–t1, the upper transistors (for example, XU1 and YU1) of the first XY-electrode line pair (for example, $X_1Y_1$) are turned off, the lower transistors (for example, XL1 and YL1) thereof are turned on, a transistor ST13 of the X-resetting circuit RE is turned on, and a transistor ST5 of the Y-resetting/addressing circuit RA is turned on. As a result, the negative voltage Vsc of a second level higher than the first level is applied to the X-electrode line $X_1$ of the first XY-electrode line pair $X_1Y_1$, and simultaneously, a positive voltage Vre of a sixth level higher than the third level is applied to the Y-electrode line $Y_1$ of the first XY-electrode line pair $X_1Y_1$. Accordingly, discharges are provoked in all discharge cells corresponding to the first XY-electrode line pair $X_1Y_1$, thereby uniformly forming wall charges and satisfactorily forming space charges.

During a first time t1–t1*a* of a second pulse width period t1–t2, immediately after the first pulse width period t0–t1 during which the line discharge step ta–t1 is performed, the upper transistors XU1 through $YU_n$ of all of the XY-electrode line pairs $X_1Y_1$ through $X_nY_n$ are turned on, the lower transistors XL1 through $YL_n$ thereof are turned off, a transistor ST10 of the X-display discharge circuit $SP_X$ is turned on, and a transistor ST4 of the Y-display discharge circuit $SP_Y$ is turned on. As a result, the positive voltage Vsh of the third level is applied to all of the X-electrode lines $X_1$ through $X_n$, and simultaneously, the negative voltage Vs1 of the first level is applied to all of the Y-electrode lines $Y_1$ through $Y_n$, so that wall charges are uniformly formed and space charges are satisfactorily formed in all of the discharge cells corresponding to the first XY-electrode line pair $X_1Y_1$.

An operation performed during a second time t1*a*–t2 is different from the operation performed during the first time t1–t1*a* in that a transistor ST10*a*, instead of the transistor ST10 in the X-display discharge circuit $SP_X$, is turned on so that the positive voltage Vpb of the fourth level lower than the positive voltage Vsh of the third level is applied to all of the X-electrode lines $X_1$ through $X_n$. The reason a display voltage applied to the X-electrode lines $X_1$ through $X_n$ is lowered will be described in detail when describing an addressing operation below.

In an erasure step performed for a predetermined time tb–tc, during a third pulse width period t2–t3 immediately after the second pulse width period t1–t2, the upper transistors XU1 and YU1 of the first XY-electrode line pair $X_1Y_1$ are turned off, the lower transistors XL1 and YL1 thereof are turned on, a transistor ST12 of the X-resetting circuit RE is turned on, and a transistor ST7 of the Y-resetting/addressing circuit RA is turned on. As a result, a positive voltage Veh of a seventh level lower than the fourth level is applied to the X-electrode line $X_1$ of the first XY-electrode line pair $X_1Y_1$, and simultaneously, a negative voltage Vel of an eighth level lower than the first level is applied to the Y-electrode line $Y_1$ of the first XY-electrode line pair $X_1Y_1$. Accordingly, wall charges are erased from all of the discharge cells corresponding to the first XY-electrode line pair $X_1Y_1$. However, the space charges satisfactorily remain in the discharge cells.

The steps of forming and erasing wall charges are sequentially performed on each of the remaining XY-electrode line pairs (see driving signals $S_{X2}$ and $S_{Y2}$ of FIG. 7).

In FIG. 7, durations td–te, th–ti, and ty–tz are addressing times, during which wall charges are formed in selected display cells, after resetting. These addressing times td–te, th–ti, and ty–tz correspond to pulse width periods t3–t4, t5–t6, and t2*n*+1–t2*n*+2, respectively, during which the negative voltage Vs1 of the first level is applied to all of the Y-electrode lines $Y_1$ through $Y_n$. Each of the pulse width periods t3–t4, t5–t6, and t2*n*+1–t2*n*+2, during which addressing is performed, is divided into a first time t3–t3*a*, t5–t5*a*, or t2*n*+1–t2*n*+1a, respectively, that does not include an addressing time and a second time t3*a*–t4, t5*a*–t6, or t2*n*+1a–t2*n*+2, respectively, that includes an addressing time.

During the first time t3–t3*a*, t5–t5*a*, or t2*n*+1–t2*n*+1*a* that does not include an addressing time, the upper transistors XU1 through $YU_n$ of all of the XY-electrode line pairs $X_1Y_1$ through $X_nY_n$ are turned on, the lower transistors XL1 through $YL_n$ thereof are turned off, the transistor ST10 of the X-display discharge circuit $SP_X$ is turned on, and the transistor ST4 of the Y-display discharge circuit $SP_Y$ is turned on. As a result, the positive voltage Vsh of the third level is applied to all of the X-electrode lines $X_1$ through $X_n$, and simultaneously, the negative voltage Vs1 of the first level is applied to all of the Y-electrode lines $Y_1$ through $Y_n$.

An operation performed during the second time t3*a*–t4, t5*a*–t6, or t2*n*+1a–t2*n*+2 is different from the operation performed during the first time t3–t3*a*, t5–t5*a*, or t2*n*+1–t2*n*+1*a* in that the transistor ST10*a*, instead of the transistor ST10 in the X-display discharge circuit $SP_X$, is turned on so that the positive voltage Vpb of the fourth level lower than the positive voltage Vsh of the third level is applied to all of the X-electrode lines $X_1$ through $X_n$.

Figure 1:
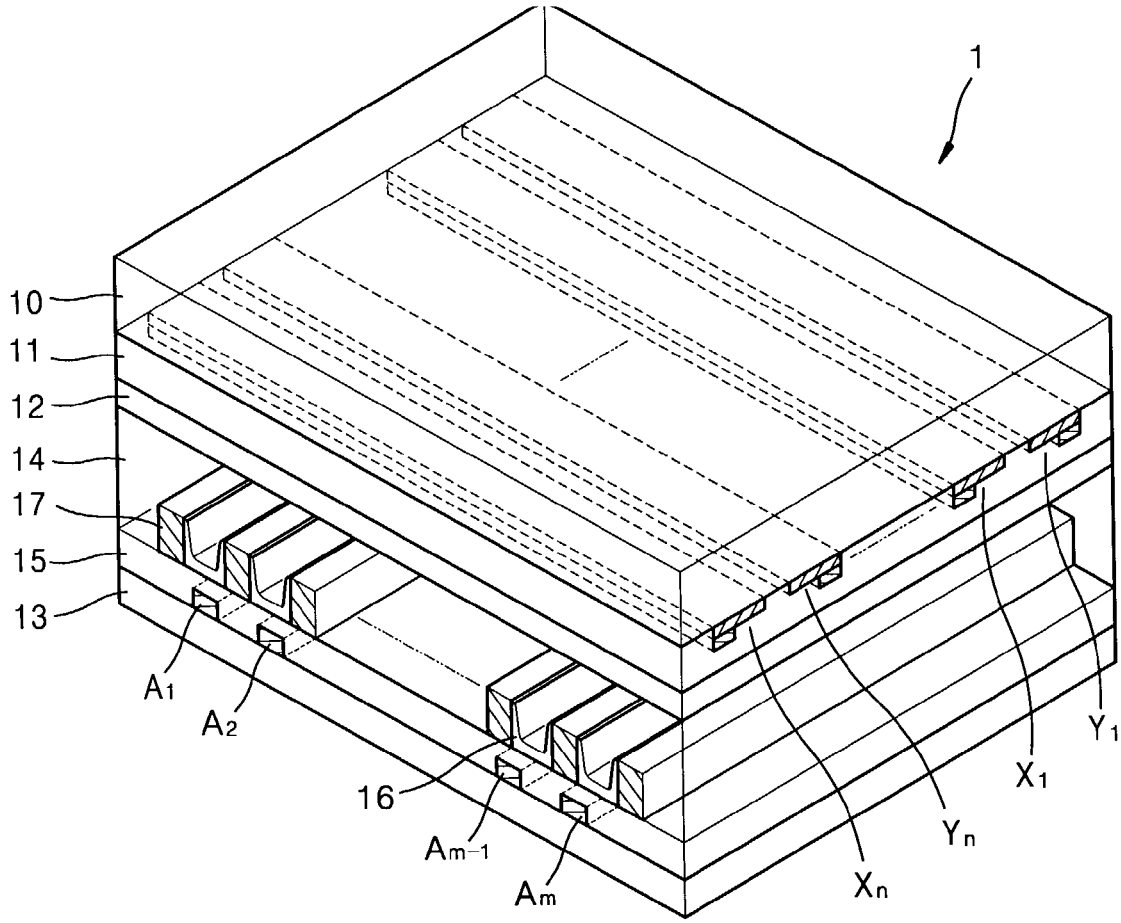
FIG. 1 (PRIOR ART)
FIG. 1 is a perspective view of the internal structure of a typical surface discharge type triode PDP.
Figure 2:
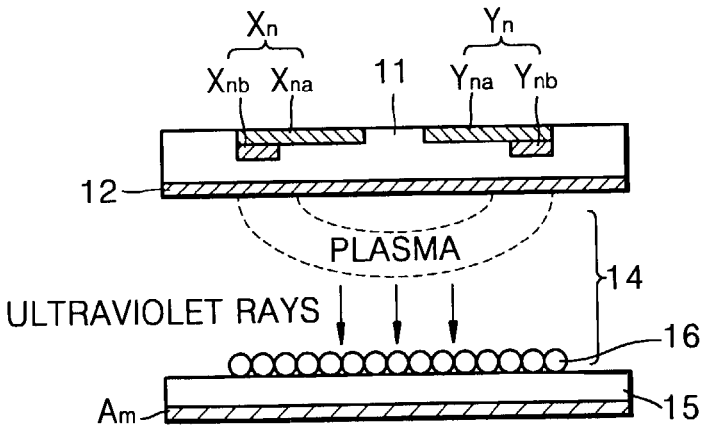
FIG. 2 (PRIOR ART)
FIG. 2 is a sectional view of an example of a display cell in the PDP shown in FIG. 1.
Figure 3:
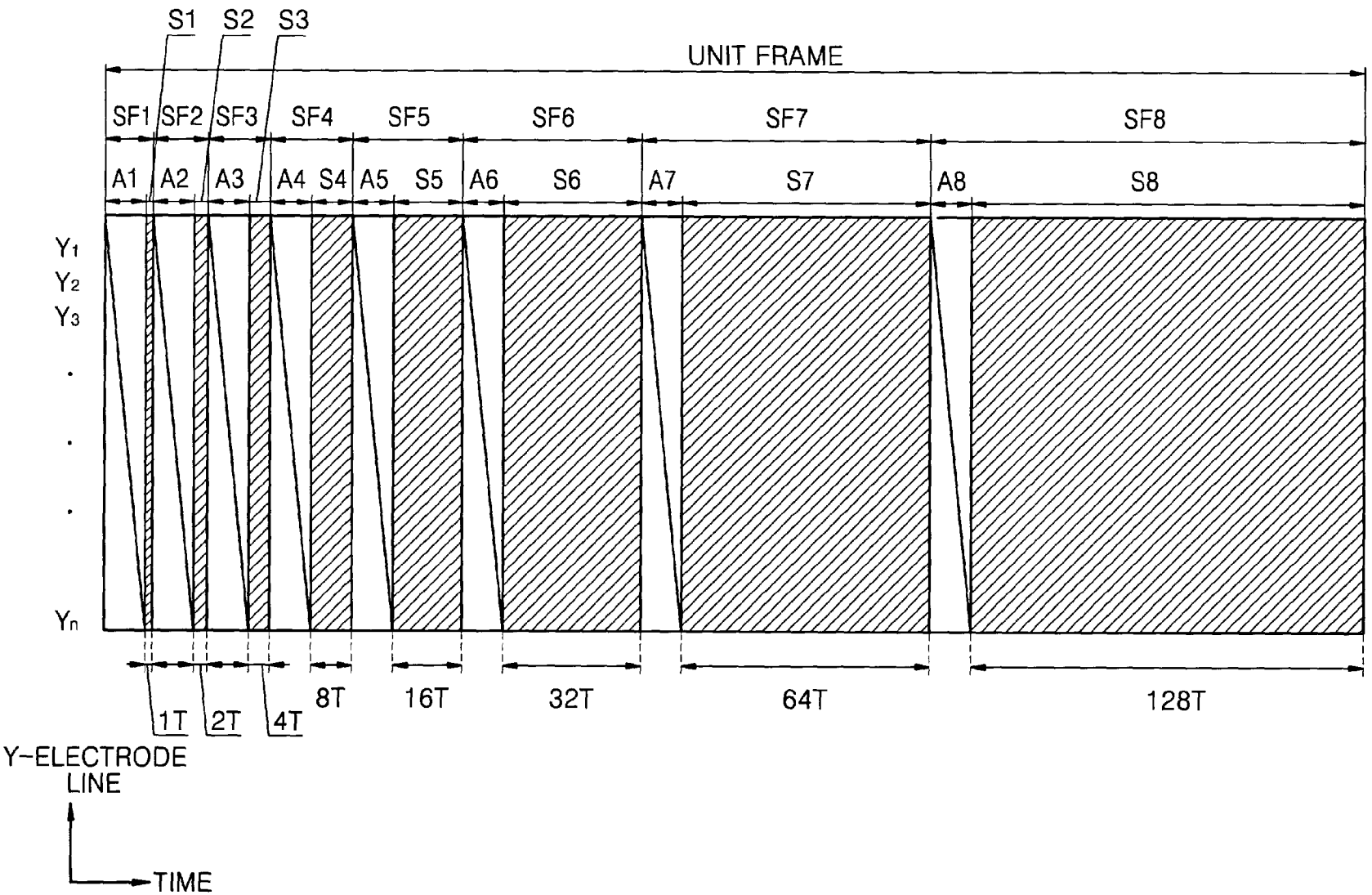
FIG. 3 (PRIOR ART)
FIG. 3 is a timing chart of a typical address-display separation driving method with respect to Y-electrode lines of the PDP shown in FIG. 1.
Figure 4:
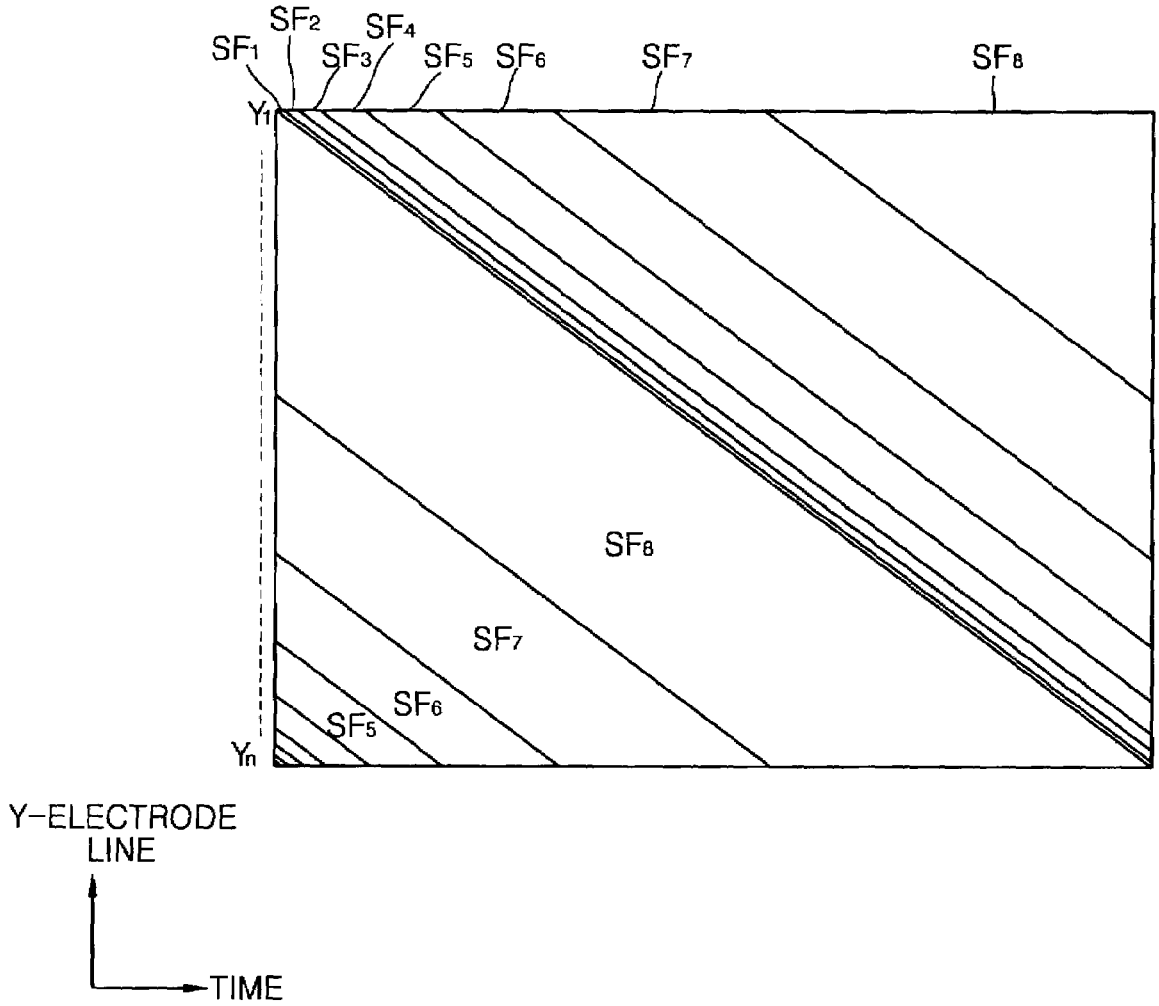
FIG. 4 (PRIOR ART)
FIG. 4 is a timing chart of a typical address-while-display driving method with respect to Y-electrode lines of the PDP shown in FIG. 1.

During the addressing times td–te, th–ti, and ty–tz included in the second times t3*a*–t4, t5*a*–t6, and t2*n*+1a–t2*n*+2, respectively, the lower transistors of the respective Y-electrode lines of XY-electrode line pairs $X_1Y_1$, $X_2Y_2$, and $X_nY_n$ and a transistor ST6 of the Y-resetting/addressing circuit RA are turned on. Accordingly, the negative scan voltage Vsc of the second level higher than the first level is applied to the Y-electrode line of each XY-electrode line pair to be addressed, and simultaneously, positive display data signals are applied to all of the address electrode lines $A_1$ through $A_m$ shown in FIG. 1. Accordingly, opposite discharges occur among the Y-electrode line of an XY-electrode line pair to be addressed and selected address electrode lines, thereby forming positive wall charges around the Y-electrode of selected display cells. In the selected display cells, display discharges are performed in response to pulses due to a wall voltage induced from the wall charges.

During the above-described addressing times td–te, th–ti, and ty–tz, the voltage Vpb, lower than the voltage Vsh applied during the first times t3–t3*a*, t5–t5*a*, and t2*n*+1t2*n*+1a, is applied to all of the X-electrode lines $X_1$ through $X_n$. Accordingly, a voltage that is applied to an XY-electrode line pair during each of the addressing times td–te, th–ti, and ty–tz is lowered so that a maximum of an address voltage Va that is applied to selected lines among the address electrode lines $A_1$ through $A_m$ increases. In other words, an applicable range, i.e., margin, of the address voltage Va is broadened. When the margin of the address voltage Va is broadened, accurate addressing can be accomplished, thereby increasing display performance.

Figure 9:
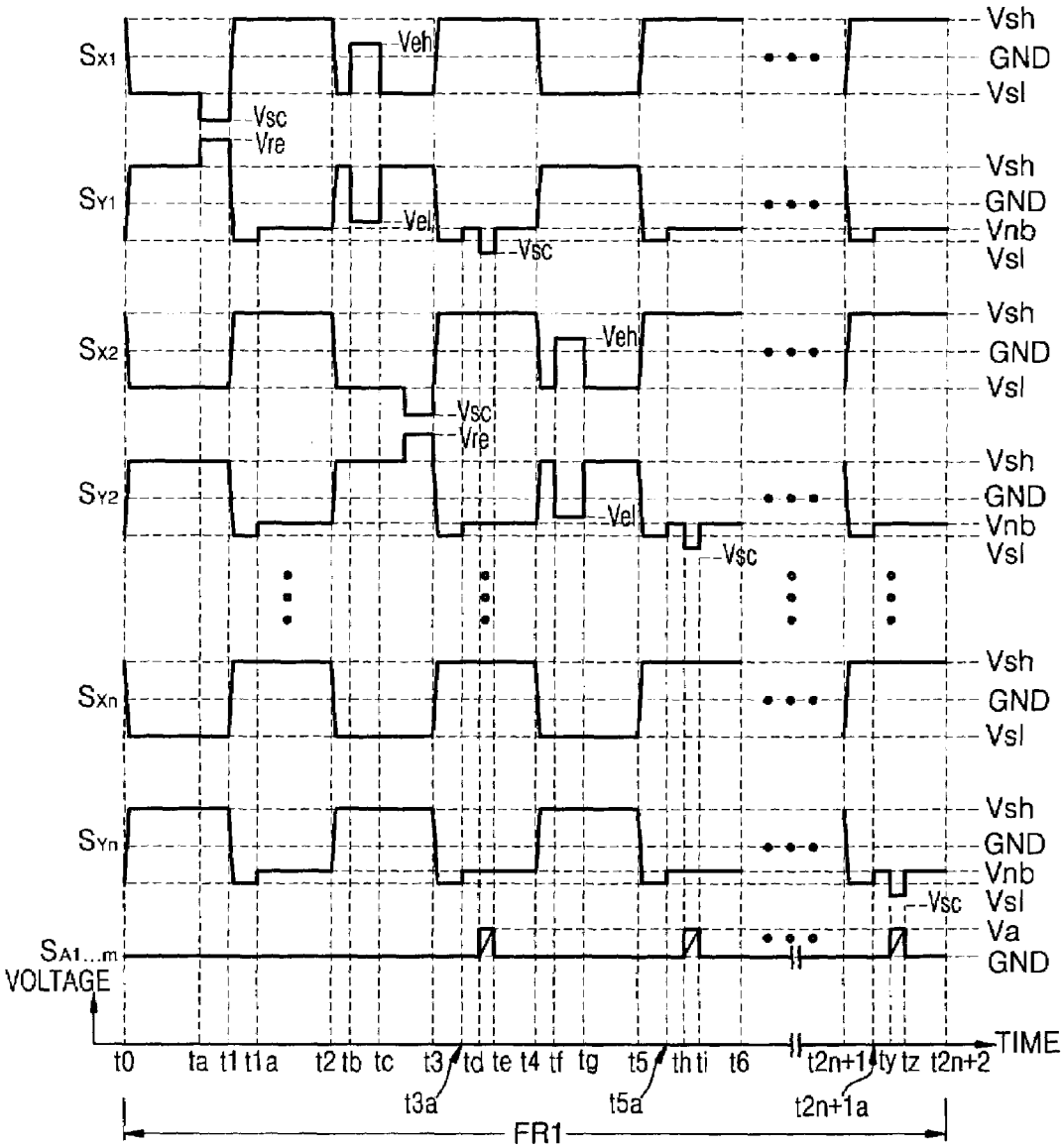
FIG. 9 is a timing chart showing driving signals that are applied to electrode lines according to an address-while-display driving method in a second embodiment of the present invention.
Figure 10:
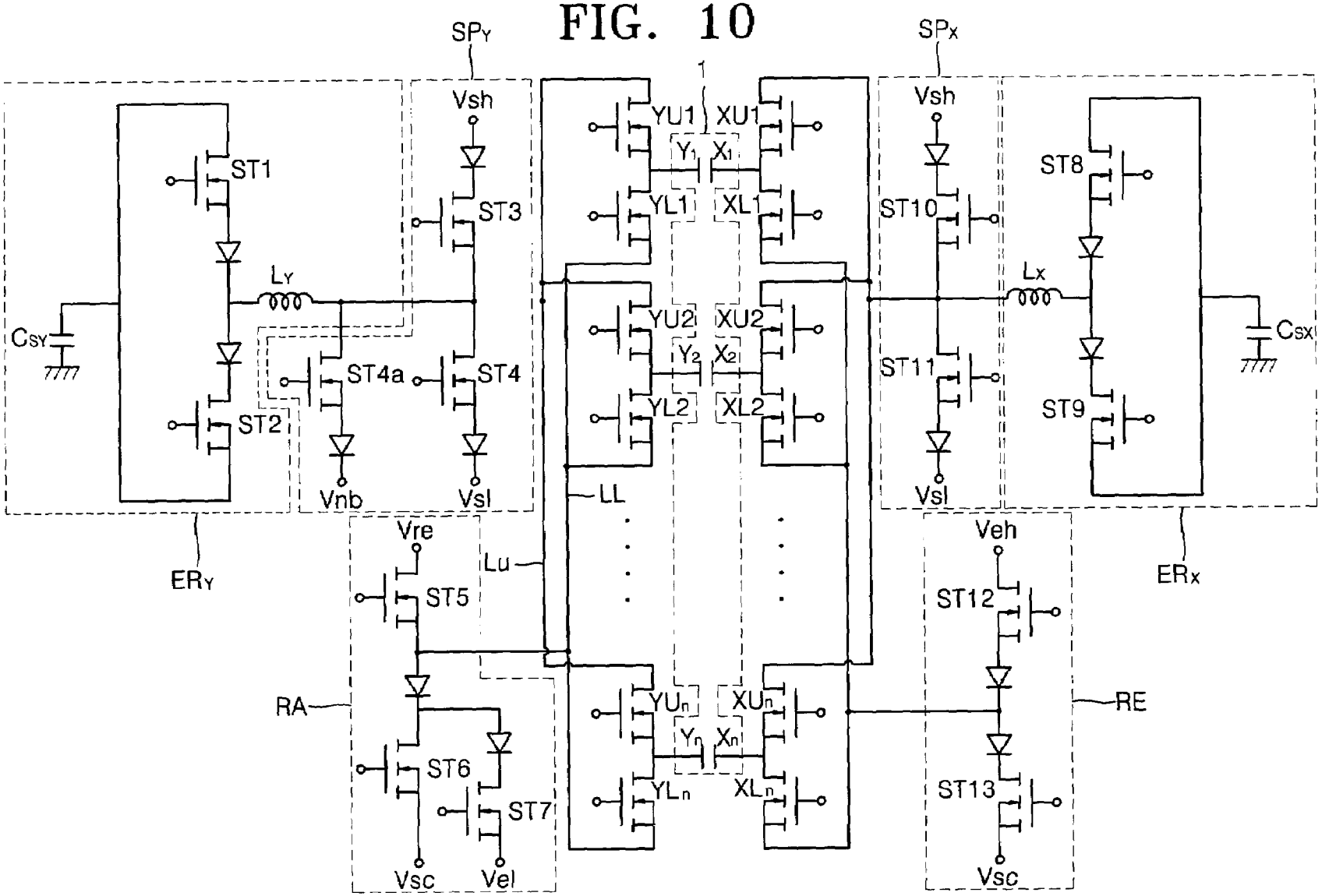
FIG. 10 is a circuit diagram of X- and Y-drivers which can perform the address-while-display driving method of FIG. 9.

FIG. 9 shows driving signals that are applied to electrode lines in an address-while-display driving method according to a second embodiment of the present invention. In FIGS. 7 and 9, the same reference characters denote the same functional element. FIG. 10 shows X- and Y-drivers that can perform the address-while-display driving method of FIG. 9. In FIGS. 8 and 10, the same reference characters denote the same functional element. The circuit shown in FIG. 10 is different from the circuit shown in FIG. 8 in that the circuit of the transistor ST10*a*, which is provided for applying the positive voltage Vpb of the fourth level to all of the X-electrode lines $X_1$ through $X_n$ in FIG. 8, is removed and that the circuit of a transistor ST4*a* for applying a negative voltage Vnb of a fifth level lower than the first level to all of the Y-electrode lines $Y_1$ through $Y_n$ is added.

Differences between the first embodiment shown in FIGS. 7 and 8 and the second embodiment shown in FIGS. 9 and 10 will be described in detail below.

During the second times t3*a*–t4, t5*a*–t6, and t2*n*+1a–t2*n*+2 including an addressing time, instead of applying the positive voltage Vsh, which is applied during the first times t3–t3*a*, t5–t5*a*, and t2*n*+1–t2*n*+1a, to all of the X-electrode lines $X_1$ through $X_n$, the negative voltage Vnb of the fifth level lower than the negative voltage Vs1, which is applied during the first times t3–t3*a*, t5–t5*a*, and t2*n*+1–t2*n*+1a, is applied to all of the Y-electrode lines $Y_1$ through $Y_n$ by turning on the transistor ST4*a* of the Y-display discharge circuit $SP_Y$.

Accordingly, a voltage that is applied to an XY-electrode line pair during each of the addressing times td–te, th–ti, and ty–tz is lowered so that a maximum of an address voltage Va that is applied to selected lines among the address electrode lines $A_1$ through $A_m$ increases. In other words, an applicable range, i.e., margin, of the address voltage Va is broadened. When the margin of the address voltage Va is broadened, accurate addressing can be accomplished, thereby increasing display performance.

Figure 11:
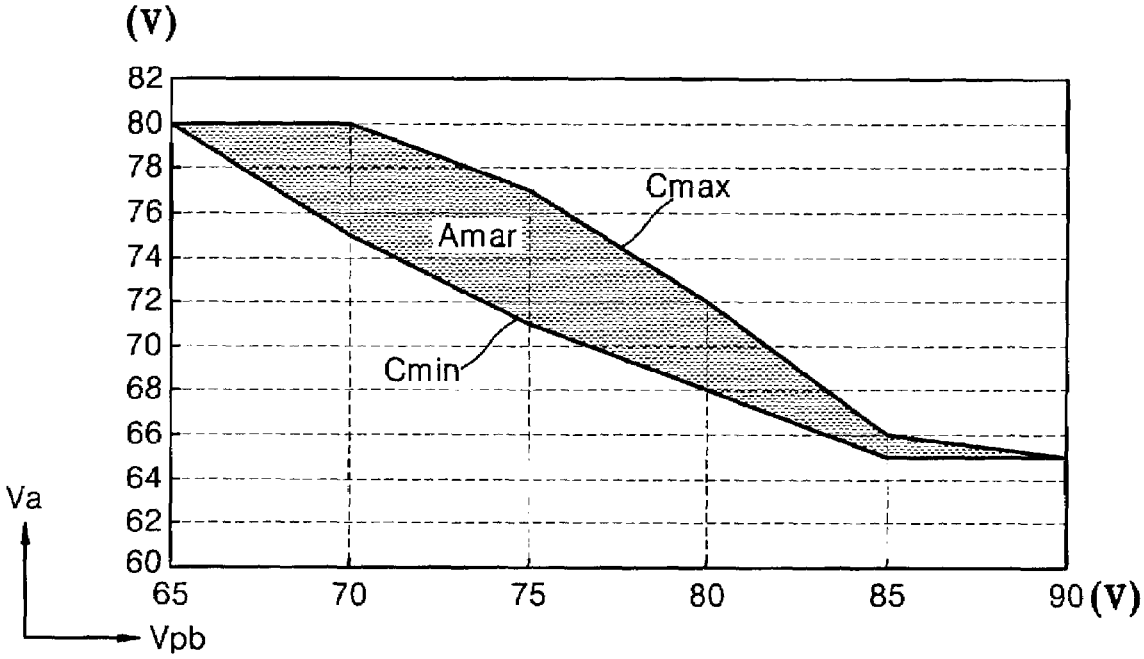
FIG. 11 is a graph showing the margin of an address voltage with respect to a voltage Vpb shown in FIG. 7.

FIG. 11 shows the margin Amar of the address voltage Va with respect to the voltage Vpb shown in FIG. 7. Here, the voltage Vpb indicates a display voltage that is applied to all of the X-electrode lines $X_1$ through $X_n$ according to an address-while-display driving method. In FIG. 11, a reference character Cmin denotes a characteristic curve of a minimum of the address voltage Va with respect to the voltage Vpb, and a reference character Cmax denotes a characteristic curve of a maximum of the address voltage Va with respect to the voltage Vpb.

Referring to FIG. 11, when the voltage Vpb is set to a high level according to conventional technology, a maximum of the address voltage Va is very low, and thus the margin Amar of the address voltage Va is narrowed. When the voltage Vpb is set to a low level according to an embodiment of the present invention, however, the margin Amar of the address voltage Va is broadened. It will be apparent that it is not necessary to remarkably increase a minimum of the address voltage Va by setting the voltage Vpb to a very low level.

As described above, according to an address-while-display driving method for a PDP according to the present invention, since a voltage applied to an XY-electrode line pair is lowered during an addressing time, a maximum of an address voltage that is applied to selected lines among all address electrode lines increases. As a result, the margin of the address voltage increases, and thus accuracy of addressing increases, thereby increasing display performance.

The present invention is not restricted to the above-described embodiments. It will be understood by those skilled in the art that various changes in form and details may be made therein without departing from the spirit and scope of the invention as defined by the appended claims.

What is claimed is:

1. An address-while-display driving method of sequentially performing resetting and addressing on each XY-electrode line pair while alternately and consecutively applying display voltages to all XY-electrode line pairs in a surface discharge type triode plasma display panel, in which said panel includes a front substrate and a rear substrate that are separately formed to face each other, X- and Y-electrode lines that are alternately arranged in parallel between the front and rear substrates to form the XY-electrode line pairs, and address electrode lines that are formed in a direction perpendicular to the X- and Y-electrode lines, the address-while-display driving method comprising the step of lowering display voltages during an addressing time for each XY-electrode line pair.

2. The address-while-display driving method of claim 1, wherein a display voltage of a first polarity and a display voltage of a second polarity opposite to the first polarity are alternately applied to all of the XY-electrode line pairs, and wherein the addressing time is a portion of a period of time during which the voltage of the second polarity at a first level is applied to each of the Y-electrode lines of each XY-electrode line pair.

3. The address-while-display driving method of claim 2, wherein during the addressing time, a scan voltage of the second polarity at a second level higher than the first level of the display voltage is applied to the Y-electrode line of each XY-electrode line pair to be addressed, and wherein simultaneously display data signals of the first polarity are applied to the address electrode lines.

4. The address-while-display driving method of claim 3, wherein while the voltage of the second polarity at the first level is applied to all of the Y-electrode lines of each XY-electrode line pair, a voltage of the first polarity at a third level is applied to all of the X-electrode lines of each XY-electrode line pair, and during the addressing time a voltage of the first polarity at a fourth level lower than the third level is applied to all of the X-electrode lines of each XY-electrode line pair.

5. The address-while-display driving method of claim 3, wherein during the addressing time, a voltage of the second polarity at a fifth level lower than the first level is applied to the Y-electrode lines of those XY-electrode line pairs that are not to be addressed.

6. The address-while-driving method of claim 1, wherein the step of lowering the display voltage during an addressing time for each XY-electrode line pair includes lowering a voltage applied to an XY-electrode line pair during selected addressing times such that a maximum of an address voltage applied to selected address electrode lines increases.

7. An address-while-display driving method of a surface discharge type triode plasma display panel including a front substrate and a rear substrate facing each other, X- and Y-electrode lines that are alternately arranged in parallel on the front substrate to form XY-electrode line pairs, and address electrode lines that are formed on the rear substrate in a direction perpendicular to the X- and Y-electrode lines, the method comprising:

sequentially performing resetting and addressing operations on each XY-electrode line pair while alternately and consecutively applying a display voltage of a first polarity and a display voltage of a second polarity opposite to the first polarity to the XY-electrode line pairs; and in the addressing operation, lowering the display voltage of the first polarity of the X electrode lines during an addressing time that is a portion of a period of time during which the display voltage of the second polarity at a first level is applied to the Y-electrode lines.

8. The method of claim 7, further comprising:

during the addressing time, applying a scan voltage of the second polarity at a second level higher than the first level to the Y-electrode line of each XY-electrode line pair to be addressed, while simultaneously applying display data signals of the first polarity to the address electrode lines.

9. The method of claim 8, wherein while the voltage of the second polarity at the first level is applied to the Y-electrode lines, a voltage of the first polarity at a third level is applied to the X-electrode lines, and during the addressing time a voltage of the first polarity at a fourth level lower than the third level is applied to the X-electrode lines.

10. An address-while-display driving method of a surface discharge type triode plasma display panel including a front substrate and a rear substrate facing each other, X- and Y-electrode lines that are alternately arranged in parallel on the front substrate to form XY-electrode line pairs, and address electrode lines that are formed on the rear substrate in a direction perpendicular to the X- and Y-electrode lines, the method comprising:

sequentially performing resetting and addressing operations on each XY-electrode line pair while alternately and consecutively applying a display voltage of a first polarity and a display voltage of a second polarity opposite to the first polarity to the XY-electrode line pairs; and in the addressing operation, lowering the display voltage of the second polarity at a first level of the Y electrode lines during an addressing time that is a portion of a period of time during which a voltage of the first polarity is applied to the X-electrode lines.

11. The method of claim 10, further comprising:

during the addressing time, applying a scan voltage of the second polarity at a second level higher than the first level to the Y-electrode line of each XY-electrode line pair to be addressed, while simultaneously applying display data signals of the first polarity to the address electrode lines.

12. The method of claim 11, wherein during the addressing time, a voltage of the second polarity at a fifth level lower than the first level is applied to the Y-electrode lines of those XY-electrode line pairs that are not to be addressed.

* * * * *